United States Patent [19]

Ishihara et al.

[11] 4,127,413

[45] Nov. 28, 1978

[54] METHOD FOR THE ADDITION OF PHOTOGRAPHIC ADDENDA

[75] Inventors: Masao Ishihara, Hino; Ryoichiro Kobayashi, Tama; Tugumoto Usui, Hachioji; Takayoshi Omura, Hino, all of Japan

[73] Assignee: Konishiroku Photo Industry Co., Ltd., Japan

[21] Appl. No.: 874,662

[22] Filed: Feb. 2, 1978

[30] Foreign Application Priority Data

Feb. 9, 1977 [JP] Japan ..... 52-13193

[51] Int. Cl.[2] ..... G03C 1/84; G03C 1/40

[52] U.S. Cl. ..... 96/56; 96/84 UV; 96/95; 96/99; 96/100 R

[58] Field of Search ..... 96/100 R, 84 UV, 95, 96/99, 56; 8/85 B

[56] References Cited

U.S. PATENT DOCUMENTS

| | | | |
|---|---|---|---|
| 2,888,313 | 5/1959 | Mautner | 8/175 |
| 3,930,866 | 1/1976 | Oishi et al. | 96/95 |

*Primary Examiner*—Travis Brown

*Attorney, Agent, or Firm*—Haseltine, Lake & Waters

[57] ABSTRACT

A method for adding oil-soluble photographic addenda in the form of their solution in a high boiling organic solvent to a hydrophilic colloidal solution for forming a layer of a light-sensitive silver halide photographic material in the homogeneously dispersed state, is described.

6 Claims, No Drawings

METHOD FOR THE ADDITION OF PHOTOGRAPHIC ADDENDA

This invention relates to a method for the addition of photographic addenda, which method comprises dissolving various oil-soluble photographic addenda by use of a high-boiling organic solvent and thereafter adding such addenda to a hydrophilic colloidal solution for forming a layer of a light-sensitive silver halide photographic material in the homogeneously dispersed state.

In the step for the preparation of a light-sensitive silver halide photographic material, various photographic addenda are added to a hydrophilic colloidal solution for forming a layer of the light-sensitive silver halide photographic material. Generally the photographic addenda are previously dissolved into a solvent such as water or an organic solvent and then added to the hydrophilic colloidal solution. For dissolving the photographic addenda, water is predominantly used by reason of unaffecting the photographic characteristics. However, since a number of various photographic addenda are substantially insoluble in water, acetone, lower alcohols such as methanol and ethanol, or a mixture thereof with water is generally used. Furthermore some photographic addenda, so-called oil-soluble photographic addenda, are substantially insoluble in such the organic solvents. The typical examples of such oil-soluble photographic addenda are couplers, UV absorbing substances, color stain inhibitors, developing inhibitor releasing compounds (DIR compounds), diffusible dye releasing redox compounds (DRR compounds), etc. As one of the methods of incorporating oil-soluble photographic addenda into a silver halide emulsion layer, auxiliary layer or the like, which is one of the layers of a light-sensitive silver halide photographic material, it is known to disperse the oil-soluble photographic addenda as a solute in the form of a small liquid drop comprising a water-immiscible organic solvent in which the oil-soluble photographic addenda are dissolved. To the organic solvents used for this purpose, the following properties are required: miscible with the oil-soluble photographic addenda; substantially dissolving the oil-soluble photographic addenda; permeable to a developing solution; not causing any crystallization, precipitation or coagulation of the oil-soluble photographic addenda contained therein; able to disperse the liquid drop particle always stably; having a refractive index as close as possible to that of a hydrophilic colloidal binder in which the organic solvents are dispersed; not causing any softening or degradation of the layer; not causing any deterioration of the physical properties of the layer.

Various high-boiling organic solvents such as described in U.S. Pat. Nos. 2,322,027 and 3,554,755 have been known as the organic solvents to disperse the oil-soluble photographic addenda in the form of small drops. For example such organic solvents include methyl-, ethyl-, butyl-, benzyl-, nonyl- or decyl-phthalate; benzyl-, butyl-o-methoxy- or n-hexyl-benzoate; triphenyl phosphate; tricresyl phosphate; p-toluenesulfonyl dimethyl amide; benzophenone; acetophenone; tetrahydrofurfuryl succinate; ethyl succinate and ethanolamine.

However, all of the oil-soluble photographic addenda do not always possess good solubility in the above-mentioned high-boiling organic solvents. For example, when some of couplers, DRR compounds or UV absorbing substances are dissolved with above highboiling organic solvents, dispersed by means of a colloid mill or homoblender and added to an emulsion or a geletine solution, the dispersion is often unstable and coating streak or degradation of image quality due to crystallization or coagulation after the addition or during coating or drying. Further, in general, highboiling organic solvents dissolving well couplers, DRR compounds or UV absorbing substances do not always show good dispersion stability and some of high-boiling organic solvents used heretofore show less dispersion stability and often cause crystallization at any stage of the aforementioned steps even though they possess high solubility.

Furthermore recently, due to high temperature and rapid processing of light-sensitive silver halide photographic material and severity in the treatment for causing no pollution, inhibition of color development of coupler is often caused by some of high-boiling organic solvents used heretofore.

Thus, the primary object of this invention is to provide a method for the addition of a photographic addenda, which enables hemogeneous and stable dispersion and incorporation of the oil-soluble photographic addenda into hydrophilic colloidal solution constituting a layer of light-sensitive silver halide photographic material.

The secondary object of this invention is to provide a method for the addition of photographic addenda, wherein a novel high-boiling organic solvent is used for dispersing and incorporating oil-soluble photographic addenda such as couplers, DRR compounds, DIR compounds or UV absorbing substances in a layer of light-sensitive silver halide photographic material in the form of a small drop particle in which said addenda are dissolved, said novel high-boiling organic solvent possessing the aforementioned desirable characteristics, particularly being able to dissolve thoroughly the oil-soluble photographic addenda and further particularly stable emulsified dispersion of small drop particles in which said addenda are dissolved.

Another object of this invention is to provide a method for the addition of photographic addenda by use of a novel high-boiling organic solvent, according to which color development of coupler is good even if the light-sensitive silver halide photographic material according to this invention is treated according to high temperature and rapid processing.

The above objects and the other objects as referred to hereinafter of this invention can be achieved by dissolving photograhic addenda with a high-boiling organic solvent represented by the following general formula

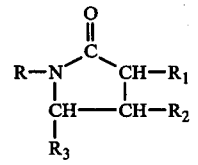

wherein R represents an alkyl group including alkyl or substituted alkyl, (e.g. alkoxyalkyl, acyloxalkyl, aminoalkyl, etc.) or alkenyl having 6 to 22 carbon atoms, $R_1$, $R_2$ and $R_3$ individually represent hydrogen, an alkyl group having 1 to 4 carbon atoms, an alkoxycarbonyl group or an acyloxy group having 1 to 10, preferably 1 to 4 carbon atoms, more preferably $R_1$, $R_2$ and $R_3$ individually are hydrogen atom, and thereafter adding the resulting solution to the hydrophilic colloidal solution which forms a layer of the light-sensitive silver halide photographic material so that said addenda may be dispersed and included therein.

Thus, by the use of at least one of the compounds of the above general formula as the high-boiling organic solvent of dispersing medium, the dispersion stability of an oil-soluble photographic addenda such as couplers, UV absorbing substances and the like can be satisfactorily met and further coating streak and degradation of image quality can be avoided. Furthermore, when this invention is applied to a light-sensitive silver halide color photographic material, the dye image obtained by color development can achieve good fastness to light, heat or humidity.

A number of couplers and UV absorbing substances which have been used heretofore are very difficult for use due to their poor solubility in high-boiling organic solvents and unsatisfactory dispersion stability, although they possess particularly excellent properties in many points. However, by the use of the high-boiling organic solvent according to this invention, it has become possible to use such prior art couplers and UV absorbing substances possessing excellent properties without causing any disadvantage. This is the great significance of this invention.

Some of the high-boiling organic solvents which have been used heretofore may increase fogging of a silver halide emulsion or cause contamination or color changes in the un-colored white background of a light-sensitive silver halide color photographic material. These disadvantages, however, are not found according to the high-boiling organic solvents to be used in this invention.

Recently, reduction of the thickness of the light-sensitive layer has been effected in order to increase the efficiency of the high temperature and rapid treatment. As one of the procedures, the amount of high-boiling organic solvent used is reduced. Some of the high-boiling organic solvents used heretofore may cause inhibition of color development of coupler due to such reduction of the amount. The high-boiling organic solvents used in this invention, however, cause no such disadvantage.

The high-boiling organic solvents of the above general formula, which are used in this invention will be exemplified below, but high-boiling organic solvents to be used in this invention should not be limited thereto.

(Exemplified compounds)

(1) 1-n-hexyl-2-pyrrolidinone

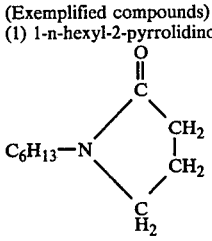

(2) 1-n-octyl-3-ethyl-2-pyrrolidinone

-continued

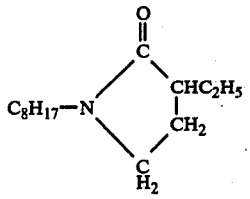

(3) 1-(2'-ethylhexyl)-2-pyrrolidinone

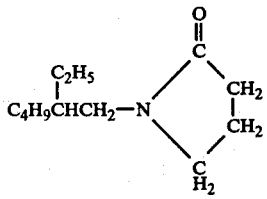

(4) 1-n-dodecyl-2-pyrrolidone

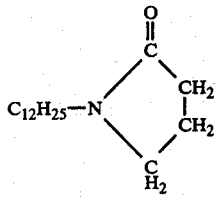

(5) 1-n-tetradecyl-2-pyrrolidinone

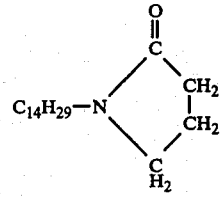

(6) 1-oleyl-2-pyrrolidinone

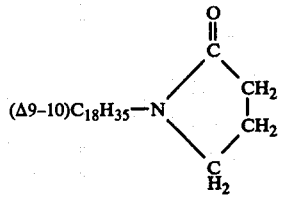

(7) 1-n-dodecyl-5-methyl-2-pyrrolidinone

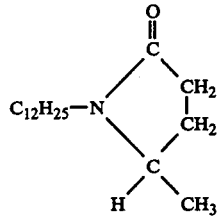

(8) 1-octyl-4-ethoxycarbonyl-2-pyrrolidinone

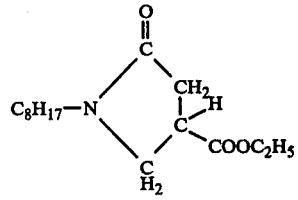

(9) 1-(2'-hexanoyloxyethyl)-2-pyrrolidinone

-continued

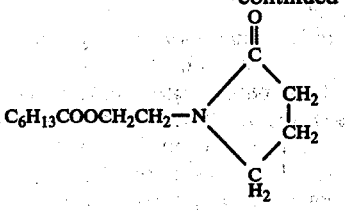

(10) 1-(3'-octyloxypropyl)-2-pyrrolidinone

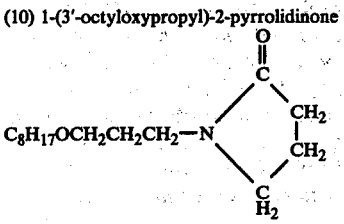

(11) 1,1'-hexamethylene-bis-(2-pyrrolidinone)

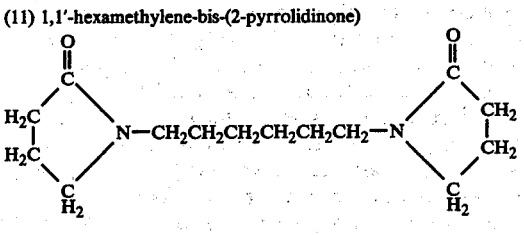

(12) 1-(4'-diethylamino-1-methylbutyl)-2-pyrrolidinone

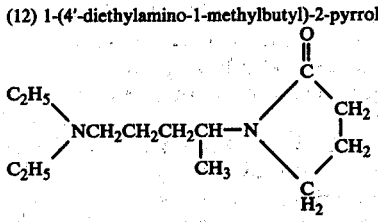

(13) 1-octyl-5-butanoyloxy-2-pyrrolidinone

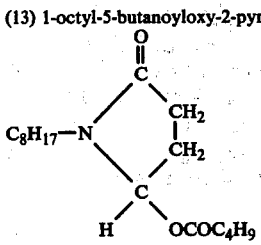

(14) 1-n-dodecyl-4-propanoyloxy-5-methylpyrrolidinone

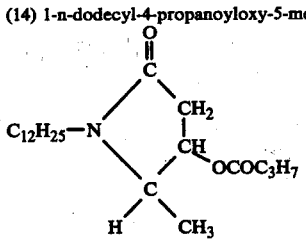

These high-boiling organic solvents used in this invention can readily be prepared by or according to the methods described in various literatures, for example, Journal of American Chemical Society, Vol. 69, 715–716 (1974). For example, the preparation is made by the reaction between γ-butyrolactone and an alkylamine or by the cyclization reaction between itaconic acid and an alkylamine or alkylene diamine.

Preparation of the above-exemplified compounds which are preferably used in this invention will be illustrated by the following Synthesis Examples:

SYNTHESIS EXAMPLE 1 [Preparation of compound (5)]

86 g Of γ-butyrolactone and 213 g of tetradecylamine are heated at 110°–130° C. for about 3 hours with stirring and further at 260°–280° C. for about 3 hours while removing water by distillation. The low-boiling fraction in the reaction mixture is removed by distillation and thereafter the residue is distilled under a reduced pressure to afford 235 g of the end product boiling at 185°–189° C./0.5mm Hg. The elemental analysis of this product is as follows:

| Elemental Analysis ($C_{18}H_{35}ON$) | C | H | N |
|---|---|---|---|
| Found (%) | 76.75 | 12.57 | 4.96 |
| Calculated (%) | 76.80 | 12.53 | 4.98 |

SYNTHESIS EXAMPLE 2 [Preparation of compound (12)]

86 g Of γ-butyrolactone and 58 g of hexamethylenediamine are heated in autoclave at 290°–300° C. for 12 hours with stirring. The low-boiling fraction in the reaction mixture is removed by distillation and thereafter the residue is distilled under a reduced pressure to afford 76 g of the end product boiling at 221°–225° C./0.45mm Hg. The elemental analysis of this product is as follows:

| Elemental Analysis ($C_{14}H_{24}O_2N_2$) | C | H | N |
|---|---|---|---|
| Found (%) | 66.68 | 9.64 | 11.05 |
| Calculated (%) | 66.63 | 9.59 | 11.10 |

SYNTHESIS EXAMPLE 3 [Preparation of compound (12)]

43 g Of γ-butyrolactone and 79 g of 4-diethylamino-1-methylbutylamine are reacted in the same manner as in Synthesis Example 1 and thereafter distillation under reduced pressure is effected to give 73 g of end product boiling at 162°–166° C./11mm Hg. The elemental analysis of this product is as follows:

| Elemental Analysis ($C_{13}H_{26}N_2O$) | C | H | N |
|---|---|---|---|
| Found (%) | 69.01 | 11.51 | 12.35 |
| Calculated (%) | 68.97 | 11.58 | 12.38 |

In practicing the method for the addition of this invention, oil-soluble photographic addenda may be dissolved in the high-boiling organic solvent according to this invention, the resulting solution may be emulsified and dispersed in a hydrophilic protective aqueous colloidal solution such as gelatine in the presence of surfactant, (for example, an anion surfactant such as alkylbenzenesulfonic acid, nonionic surfactant such as saponin, cationic surfactant such as quaternary ammonium salt of alkylamine) by means of a colloid mill or homo-blender and thereafter the dispersed solution may be added to and dispersed homogeneously in the gelatine-silver halide emulsion or the hydrophilic protective aqueous colloidal solution which forms auxiliary layer (for example, an inter layer, an anti-halation layer or a protective layer). Alternatively, a solution of the oil-soluble photographic addenda dissolved in the high-boiling organic solvent may directly be added to the coating solution for forming a layer of the light-sensitive silver halide photographic material and emulsified and dispersed therein. In the present invention, the objects can satisfactorily be achieved by using high-boiling organic solvents of the general formula alone in order to disperse the oil-soluble photographic addenda. If necessary, however, a low-boiling organic solvent can be used in combination therewith, as a co-solvent. As such low-boiling organic solvents that can be used in combination, those described in U.S. Pat. Nos. 2,801,170; 2,801,171 and 2,949,360 are included and, for example, methyl isobutyl ketone, β-ethoxyethyl acetate, methoxy triglycol acetate, acetone, methylacetone, methanol, ethanol, acetonitrile, dioxane, dimethylformamide, dimethyl sulfoxide, ethyl acetate, butyl acetate, isopropyl acetate, butanol, chloroform, cyclohexane, cyclohexanol or fluorinated alcohol can be used.

The amount of the high-boiling organic solvents to be used can be selected optionally according to the oil-soluble photographic addenda such as couplers, UV absorbing substances, and the like. When the solvent is used in too much amount, for example, when in a multilayer light-sensitive silver halide color photographic material, the solvent is contained in a large amount in the emulsion layer and/or UV absorbing layer coated on the upper side, the developing properties of the emulsion layer coated on the under side will be degraded. Furthermore, the physical properties of the emulsion layer or gelatine layer in which the high-boiling organic solvent is contained may be degraded. Therefore, the high-boiling organic solvents are suitably used in an amount within the range of the ratio of 0.1–8.0 by weight based on the respective oil-soluble photographic addenda.

Further, the high-boiling organic solvents of the general formula according to this invention may be added, if necessary, alone to the hydrophilic colloidal solution for forming a layer of a light-sensitive silver halide photographic material. Thus, the solvents may be added alone to the protective layer as a lubricant or to the inter layer in order to control the physical properties of layers for forming the multilayer light-sensitive silver halide photographic material.

The hydrophilic colloidal solution for forming a layer of the light-sensitive silver halide photographic material, in which the oil-soluble photographic addenda are contained and dispersed according to the method of addition of this invention, is coated on a suitable support, for example, plastic film, resin-coated paper, baryta paper, etc. and then dried to give light-sensitive silver halide photographic material. Light-sensitive silver halide photographic materials which can be prepared by the application of the method of addition of this invention include any of those for use in color photography, black and white photography, or for use for general or special purpose and the application of this invention is particularly effective in the preparation of the light-sensitive silver halide color photographic material.

The most typical silver halide emulsion for the practice of this invention is usually the gelatin-silver halide emulsion but in addition, there can be used a silver halide emulsion combined with acetylated gelatin, phthalated gelatin, or a water-soluble cellulose derivative, polyvinyl alcohol or other hydrophilic synthetic or natural high molecualr compound or the mixture thereof with gelatin. Even when the hydrophilic colloidal solution for forming a layer of the light-sensitive silver halide photographic material is the hydrophilic protective colloid for forming an auxiliary layer other than the above silver halide emulsion, gelatin is generally used but the other protective colloid as mentioned above may be used.

Typical oil-soluble addenda which can be dispersed into the hydrophilic colloidal solution by the use of the above described high boiling organic solvents, are couplers, UV absorbing substances, color stain inhibitors, antioxidants, DIR compounds capable of reacting with oxidized developing agent to release development inhibitors, DRR compounds capable of reacting with an oxidized developing agent to release dyes, DDR couplers capable of coupling with an oxidized developing agent to release dyes, dye developing agents, etc. and concrete exemplification will be shown below.

I. Coupler

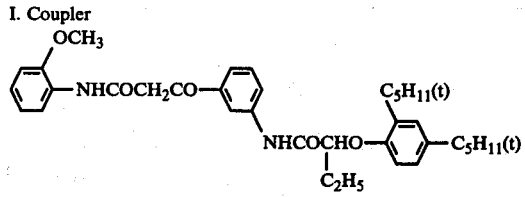

(Y - 1)

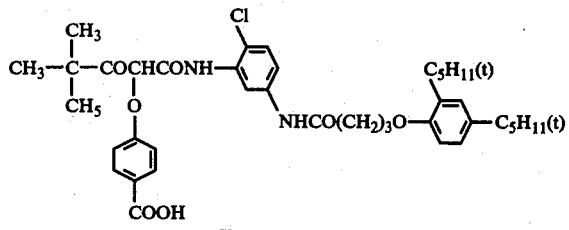

(Y - 2)

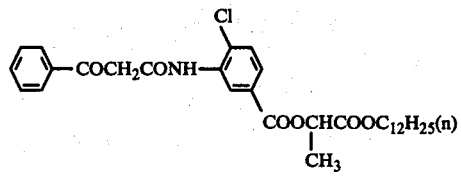

(Y - 3)

-continued (Y - 4)

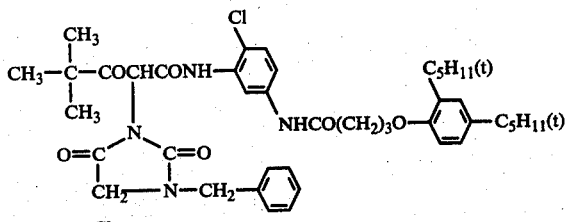

(M - 1)

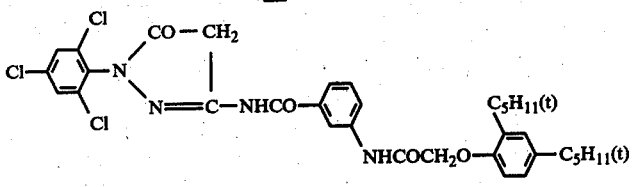

(M - 2)

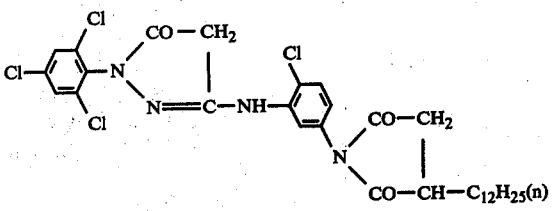

(C - 1)

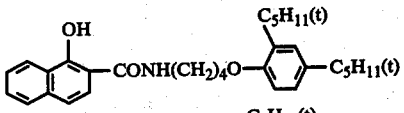

(C - 2)

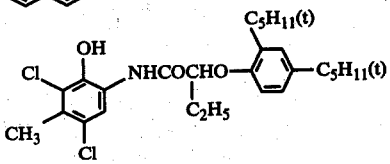

II. UV Absorber:

(U - 1)

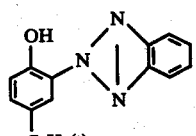

(U - 2)

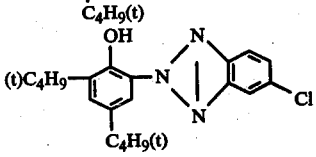

III. Other oil-soluble photographic addenda:

2,5-di-tert-butylhydroquinone (A - 1)

2,5-di-tert-octylhydroquinone (A - 2)

2-(1-phenyl-5-tetrazolylthio)-4-(2,4-d-tert-amylphenoxy-acetamide)-indanone (A - 3)

(A - 4)

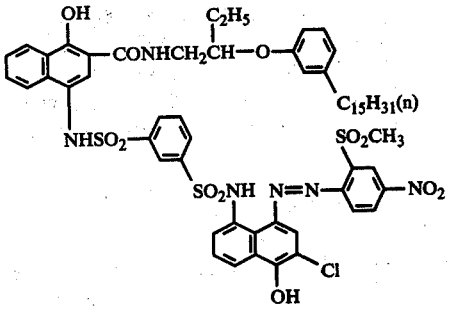

-continued (A - 5)

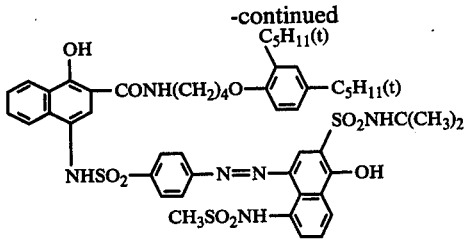

(A - 6)

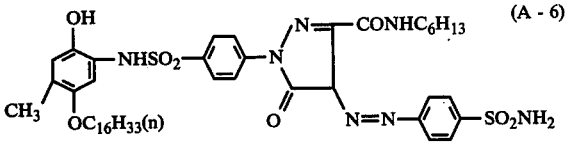

This invention will further be illustrated by the following Examples but the embodiments of this invention should not be limited to these Examples:

EXAMPLE 1

An emulsified dispersion solution of UV absorbing substances (U-2) was prepared with the following composition:

| | | |
|---|---|---|
| UV absorbing substances (U-2) | 6 | g |
| high-boiling organic solvent | 8 | g |
| ethyl acetate | 20 | ml |
| sodium dodecylbenzenesulfonate | 0.4 | g |
| 5% gelatine solution | 100 | ml |

The UV absorbing substances was added to the mixture of a high-boiling organic solvent as specified below and ethyl acetate and dissolved by heating to 70° C. The resulting solution was added to the 5% gelatine solution containing sodium dodecylbenzenesulfonate and the mixture was emulsified and dispersed for 20 minutes by a colloid mill. Then, the total amount of the resulting emulsified dispersion solution was added to 120 ml of 5% gelatine solution and allowed to stand for 6 hours at 40° C. Thereafter, the solution was coated on the silver halide color photographic emulsion applied on film support and dried.

High-boiling organic solvent used being:

Compound (12)

Comparative compound (1) . . . dibutyl phthalate

Comparative compound (2) . . . tricresyl phosphate

As a result, crystallization was occurred in the emulsifying and dispersing stage in the case where comparative compound (1) or (2) is used as the highboiling organic solvent, whereas no coagulation or crystallization of the UV absorbing substances was caused in the case of compound (12) of this invention at any stage during emulsifying and dispersion, after the addition of the emulsified dispersion solution to the gelatine solution, during coating or drying on film or after ordinary color development. Thus, the emulsified dispersion solution according to this invention was very stable and good UV absorbing effect was achieved thereby.

EXAMPLE 2

Emulsified dispersion solution of yellow coupler (Y-2) was prepared with the following composition:

| | | |
|---|---|---|
| yellow coupler (Y-2) | 5 | g |
| high-boiling organic solvent | 5 | g |
| ethyl acetate | 6 | ml |
| sodium dodecylbenzenesulfonate | 0.3 | g |
| 5% gelatine solution | 60 | ml |

The yellow coupler was added to the mixture of a high-boiling organic solvent as specified below and ethyl acetate and dissolved by heating to 70° C. The resulting solution was added to the 5% gelatine solution containing sodium benzenesulfonate and the mixture was emulsified and dispersed for 20 minutes in a colloid mill. Then, the total amount of the resulting emulsified dispersion solution was added to 200 g of a blue-sensitive silver chlorobromide emulsion. After addition of a stabilizer, the mixture was allowed to stand for 6 hours at 40° C. and then coated on baryta paper and dried.

High-boiling organic solvents used being:

Compound (9)

Comparative compound (2)

As a result, comparative compound (2) of the high-boiling organic solvents afforded crystallization of the coupler during the emulsifying and dispersing stage, whereas compound (9) according to this invention caused neither crystallization nor coagulation of the coupler at any stage during emulsifying and dispersion, after the addition of the emulsified dispersion solution to the silver halide emulsion or during coating or drying on the baryta paper. Further, the photographic characteristics achieved thereby was good.

EXAMPLE 3

In the procedure of Example 2, 0.2 g of other oil-soluble photographic addenda (A-2) was also emulsified and dispersed together with yellow coupler (Y-2) and the further treatments were effected in a similar manner. The result obtained was analogous to that of Example 2.

EXAMPLE 4

Emulsified dispersion solution of yellow coupler (Y-3) was prepared with the following composition:

| | | |
|---|---|---|
| yellow coupler (Y-3) | 8 | g |
| high-boiling organic solvent | 4 | g |
| ethyl acetate | 24 | ml |
| sodium dodecylbenzenesulfonate | 0.6 | g |
| 5% gelatine solution | 100 | ml |

The yellow coupler was added to a high-boiling organic solvent as specified below and dissolved by heating. Thereafter, the solution was added to the 5% gelatine solution containing sodium dodecylbenzenesulfonate and the mixture was emulsified and dispersed for 10 minutes by a colloid mill. Then, the total amount of the resulting emulsified dispersion solution was added to 200 g of a silver bromide emulsion. After addition of a stabilizer, the mixture was allowed to stand for 6 hours at 40° C. and then coated on resin-coated paper and dried.

High-boiling organic solvents used being:

Compound (5)

Comparative compound (1)

Comparative compound (2)

As a result, comparative compounds (1) and (2) caused crystallization after the addition of the emulsified dispersion solution to the silver halide emulsion.

To the contrary, compound (5) according to this invention caused neither crystallization nor coagulation of the coupler at any stage during emulsifying and dispersion, after the addition of the emulsified dispersion to the silver halide emulsion or during coating and drying. Further, a yellow image excellent in the spectral absorption characteristics was obtained by an ordinary color development.

EXAMPLE 5

Emulsified dispersion solution of yellow coupler (Y-4) was prepared with the following composition:

| | | |
|---|---|---|
| yellow coupler (Y-4) | 11 | g |
| high-boiling organic solvent | 5 | g |
| ethyl acetate | 6 | ml |
| sodium dodecylbenzenesulfonate | 0.3 | g |
| 5% gelatine solution | 60 | ml |

The yellow coupler was added to the mixture of a high-boiling organic solvent as specified below and ethyl acetate and dissolved by heating to 70° C. The resulting solution was added to the 5% gelatine solution containing sodium benzenesulfonate and the mixture was emulsified and dispersed for 20 minutes in a colloid mill. Then, the total amount of the resulting emulsified dispersion was added to 200 g of blue-sensitive silver iodobromide emulsion. After the addition of a stabilizer, the emulsion was coated on cellulose triacetate film base and dried.

High-boiling organic solvents used being:

Compounds (5), (6), (12) and (14)

Comparative compound (1)

Five types of light-sensitive materials thus obtained were ordinarily exposed and developed according to the following step:

| Treatment step (38° C) | Treatment Time |
|---|---|
| Color development | 3 min. 15 sec. |
| Bleaching | 6 min. 30 sec. |
| Washing with water | 3 min. 15 sec. |
| Fixation | 6 min. 30 sec. |
| Washing with water | 3 min. 15 sec. |
| Stabilization | 1 min. 30 sec. |

The composition of the solution used in the above treatments was as follows:

| Composition of color developing solution: | | |
|---|---|---|
| 4-amino-3-methyl-N-ethyl-N-(β-hydroxyethyl)-aniline sulfate | 4.75 | g |
| anhydrous sodium sulfite | 4.25 | g |
| hydroxylamine ½ sulfate | 2.0 | g |
| anhydrous potassium carbonate | 37.5 | g |
| sodium bromide | 1.3 | g |
| nitrilotriacetic acid 3 sodium salt (monohydrate) | 2.5 | g |
| potassium hydroxide | 1.0 | g |
| water to make up | 1 | liter |
| pH being adjusted to 10.0 with potassium hydroxide. | | |

| Composition of bleaching solution: | | |
|---|---|---|
| ethylenediaminetetraacetic acid iron ammonium salt | 100.0 | g |
| ethylenediaminetetraacetic acid 2 ammonium salt | 10.0 | g |
| ammonium bromide | 150.0 | g |
| glacial acetic acid | 10.0 | ml |
| Water to make up | 1 | liter |
| pH being adjusted to 6.0 with aqueous ammonia. | | |

| Composition of fixing solution: | | |
|---|---|---|
| ammonium thiosulfate (50% aqueous solution) | 162 | ml |
| anhydrous sodium sulfite | 12.4 | g |
| water to make up | 1 | liter |
| pH being adjusted to 6.5 with acetic acid. | | |

| Composition of stabilizing solution: | | |
|---|---|---|
| formalin (37% aqueous solution) | 5.0 | ml |
| Konidax (manufactured by Konishiroku Photo Industry Co., Ltd.) | 7.5 | ml |
| water to make up | 1 | liter |

Color development was effected under the above conditions.

Density of the resulting yellow image was measured by means of the densitometer (KD-7R type, manufactured by Konishiroku Photo Industry Co., Ltd.) and speed, fog and maximum density (D-max) were calculated. The speed is defined in term of relative speed based on the comparative compound. The results obtained are shown in Table 1.

Table 1

| | Speed | Fog | D-max |
|---|---|---|---|
| Comparative compound (1) | 100 | 0.04 | 1.54 |
| Compound (5) | 182 | 0.11 | 2.70 |
| Compound (6) | 180 | 0.09 | 2.66 |
| Compound (12) | 166 | 0.08 | 2.43 |
| Compound (14) | 171 | 0.10 | 2.57 |

As apparent from table 1, the color developing speed and maximum density achieved by the use of the high-boiling organic solvents according to this invention are higher as compared with the case where the comparative compound is used and accordingly it can be understood that such high-boiling organic solvents are preferable solvents for coupler and suitable for use in the high temperature and rapid process.

What we claim is:

1. In a method for the addition of oil-soluble photographic addenda to a hydrophilic colloidal solution for forming a layer of a light-sensitive silver halide photographic material which method comprises;
   (a) dissolving said addenda with a high-boiling organic solvent,
   (b) and thereafter dispersing, into the hydrophilic colloidal solution, the addenda dissolved in the high-boiling organic solvent, the improvement comprising said high boiling organic solvent being represented by the following general formula:

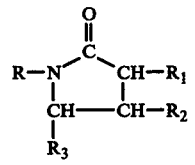

wherein R represents an alkyl group or alkenyl having 6 to 22 carbon atoms, $R_1$, $R_2$ and $R_3$ individually represent hydrogen, an alkyl group having 1 to 4 carbon atoms, an alkoxy carbonyl group or an acyloxy group having 1 to 10 carbon atoms.

2. A method according to claim 1 wherein $R_1$, $R_2$ and $R_3$ individually represent hydrogen.

3. A method according to claim 2 wherein said addenda are selected from the group consisting of couplers, UV absorbing substances and color stain inhibitors.

4. A method according to claim 2 wherein said addenda are selected from the group consisting of diffusible dye releasing redox compounds and development inhibitor releasing compounds.

5. A method according to claim 2 wherein said hydrophilic colloidal solution is a gelatin or a gelatin derivative solution.

6. A method according to claim 2 wherein said layer is selected from the group consisting of a silver halide emulsion layer, an intermediate layer, a protective layer and an antihalation layer.

* * * * *